US008387222B2

(12) United States Patent
Chen et al.

(10) Patent No.: US 8,387,222 B2
(45) Date of Patent: Mar. 5, 2013

(54) PEN BARREL ASSEMBLING DEVICE

(76) Inventors: Wen-Ming Chen, Taichung (TW); Steven Eugene Siddall, Woodstock (CA)

( * ) Notice: Subject to any disclaimer, the term of this patent is extended or adjusted under 35 U.S.C. 154(b) by 320 days.

(21) Appl. No.: 12/911,706

(22) Filed: Oct. 25, 2010

(65) Prior Publication Data

US 2011/0094077 A1 Apr. 28, 2011

(30) Foreign Application Priority Data

Oct. 26, 2009 (TW) ..... 98219727 U

(51) Int. Cl.
*B25B 27/14* (2006.01)

(52) U.S. Cl. ..... 29/281.1; 29/281.5; 29/283; 269/55; 269/43; 269/314

(58) Field of Classification Search ..... 29/281.1, 29/281.3, 281.4, 281.5, 283; 269/291, 55, 269/246, 43, 314
See application file for complete search history.

(56) References Cited

U.S. PATENT DOCUMENTS

| | | | | |
|---|---|---|---|---|
| 7,421,768 | B2 * | 9/2008 | Chiang | 29/237 |
| 7,426,778 | B2 * | 9/2008 | Nobusawa | 29/227 |
| 7,836,570 | B2 * | 11/2010 | Swenson | 29/281.1 |
| 7,900,898 | B2 * | 3/2011 | Wampler, II | 269/152 |
| 8,210,510 | B2 * | 7/2012 | Li et al. | 269/246 |
| 2005/0225019 | A1 * | 10/2005 | Hubbard | 269/267 |
| 2011/0094077 | A1 * | 4/2011 | Siddall et al. | 29/281.1 |

* cited by examiner

*Primary Examiner* — Lee D Wilson

(57) ABSTRACT

A pen barrel assembling device includes a base with a first frame and a second frame fixed to the top of two ends of the base. A movable rod extends through the first frame and fixed to the first frame by a first fixing bolt. An end part is connected to the first end of the movable rod and the outer section is positioned in the end part. A push rod extends through the second frame and is movable toward the movable rod by pivoting a lever. The metal section is connected to the free end of the push rod. Multiple blocks are pivotably or slidably connected to the base and each block includes an engaging recess which is removably engaged with the movable rod.

10 Claims, 12 Drawing Sheets section: a-a

PEN BARREL ASSEMBLING DEVICE

FIELD OF THE INVENTION

The present invention relates to an assembling device, and more particularly, to an assembling device for connecting a metal section into an outer section to form a customer-made pen barrel.

BACKGROUND OF THE INVENTION

A conventional customer-made pen generally includes a decorated barrel which includes a metal section 7 inserted into an outer section 6 as shown in FIGS. 9 and 10. The tolerance between the metal section 7 and the outer section 6 is so small that an assembling device 5 is needed to insert the metal section 7 into the outer section 6. The assembling device 5 includes a fixed frame 54 on one end of the base and a movable rod 52 movably extends through the fixed frame 54. An end part 53 is fixed to the distal end of the movable rod 52 and a recess is defined in the free end of the end part 53. A frame is fixed on the other end of the base and includes a link pivotably connected between a lever and a push rod. The outer section 6 is inserted into the recess in the end part 53 and the metal section 7 connected to the distal end of the push rod. By pivoting the lever, the push rod moves the metal section 7 toward the outer section 6 and forces the metal section 7 into the outer section 6. A block unit 51 includes multiple blocks 511, 512, 513 of different lengths and the blocks 511, 512, 513 are selectively mounted to the movable rod 52 and clamped between the fixed frame 54 and the end part 53 so as to set a fixed distance between the end part 53 and the distal end of the push rod. The distance is the length of the barrel.

However, the blocks 511, 512, 513 are easily lost because the assembling device lacks a proper storage place for the blocks 511, 512, 513. Once the blocks 511, 512, 513 are lost, the user has to unscrew the positioning bolts 541 which fix the movable rod 52 to the fixed frame 54, and then move the movable rod 52 to desired position and fix the movable rod 52 by the positioning bolts 541. This often requires several times of try to correctly set the movable rod 52 and increases the time required.

The present invention intends to provide a pen barrel assembling device which improves the shortcomings of the conventional pen barrel assembling device.

SUMMARY OF THE INVENTION

The present invention relates to a pen barrel assembling device and comprises a base and a first frame is fixed to a top of a first end of the base. A movable rod extends through a passage defined longitudinally through the first frame and a first fixing bolt extends through the first frame to fix the movable rod relative to the first frame. An end part is connected to a first end of the movable rod and a recess is defined in a free end of the end part. A push unit is connected to the top of a second end of the base and comprises a second frame with a push rod extending therethrough which is located in alignment with the movable rod. A link is pivotably connected between the push rod and a lever so that the push rod is moved toward the movable rod by pivoting the lever. A head is connected to a free end of the push rod. Multiple blocks are pivotably or slidably connected to the base and each block includes an engaging recess which is removably engaged with the movable rod.

The primary object of the present invention is to provide a pen barrel assembling device wherein the blocks are well positioned on the base and easily to use. The blocks are either pivoted or slid to engage with the movable rod.

Another object of the present invention is to provide a pen barrel assembling device wherein the blocks have different sizes so as to set the distance between the end part and the head for manufacturing the barrels of different lengths.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
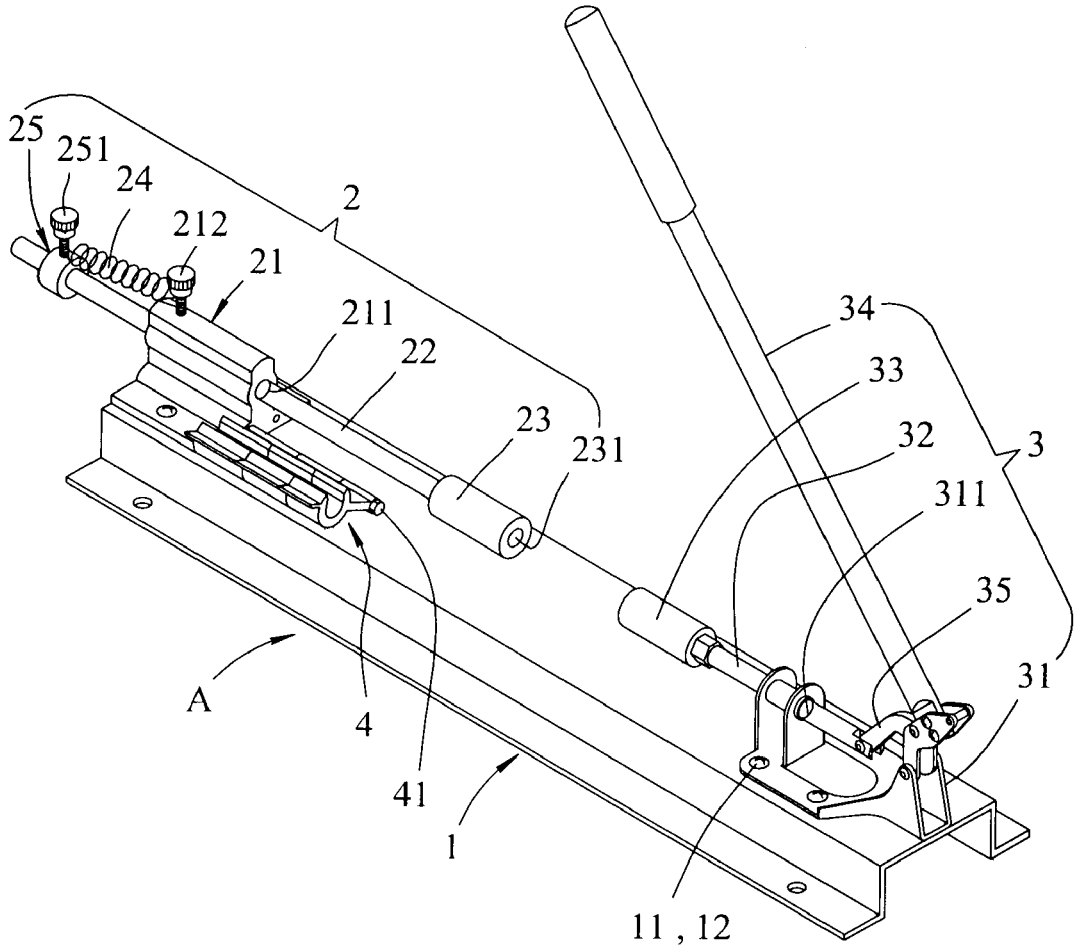
FIG. 1 is a perspective view to show the pen barrel assembling device of the present invention.
Figure 2:
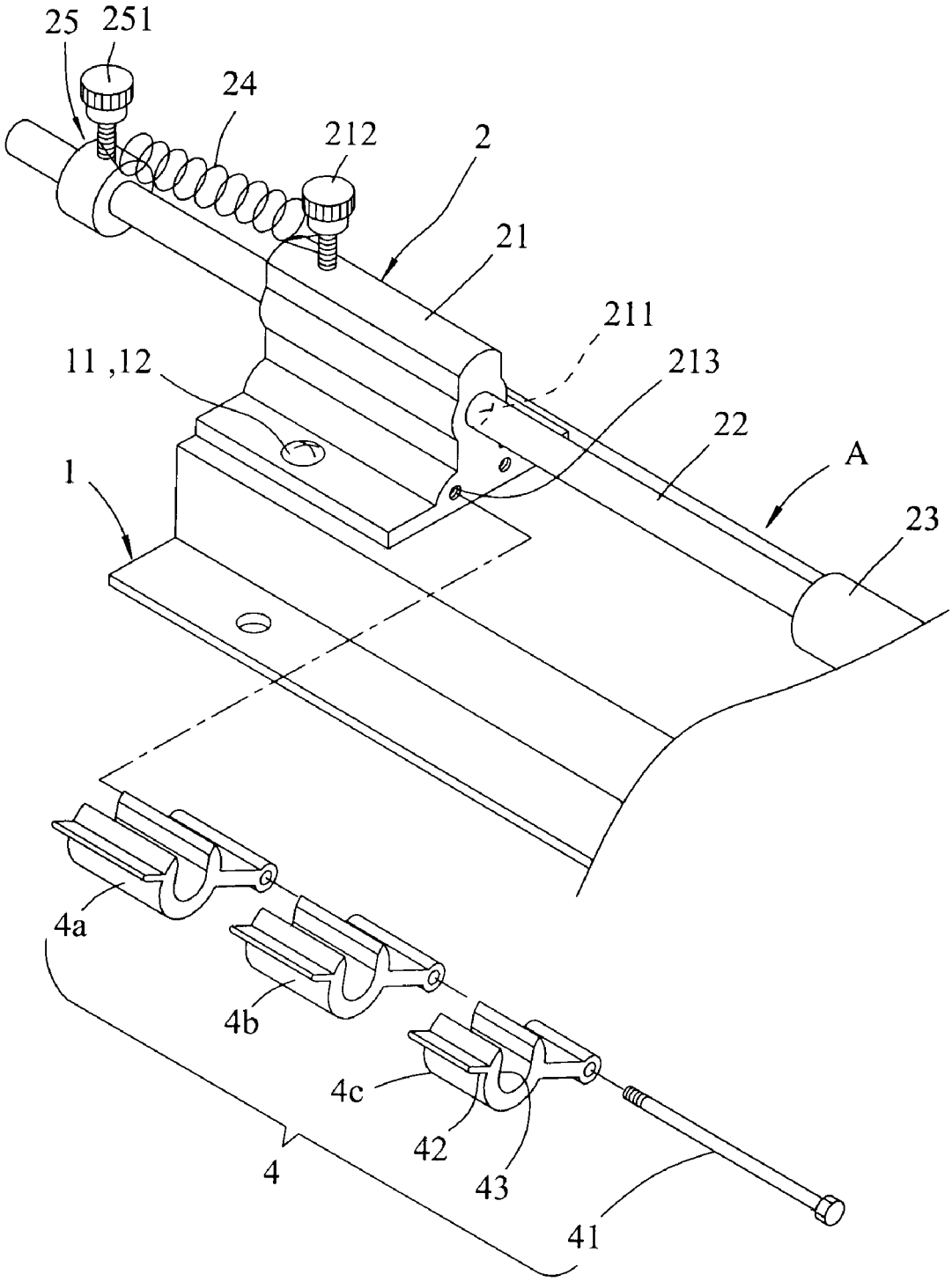
FIG. 2 is an exploded view to show the pen barrel assembling device of the present invention.
Figure 3:
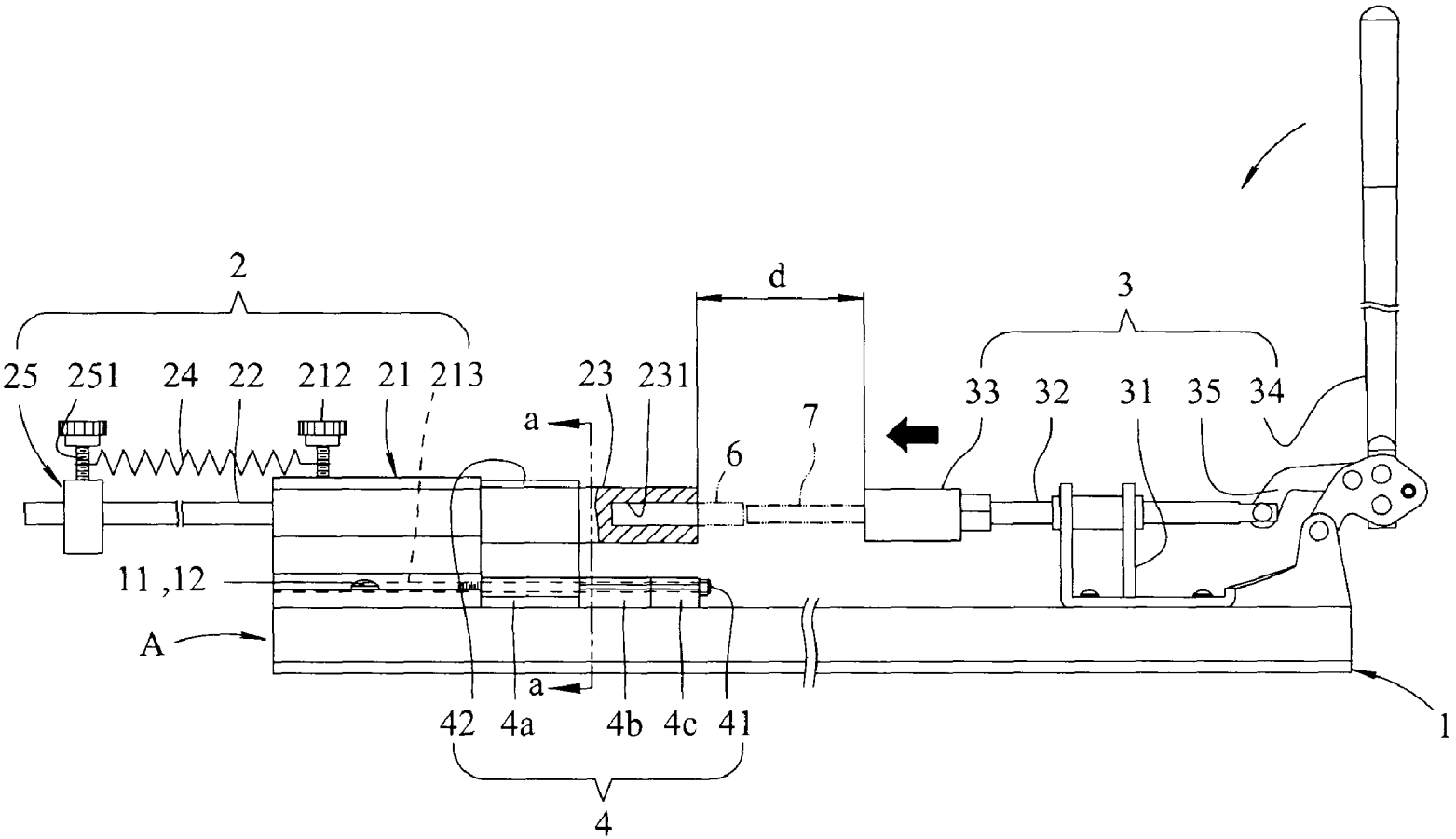
FIG. 3 shows a side view of the pen barrel assembling device of the present invention, wherein a longer barrel is assembled.

Referring to FIGS. 1 to 3, the pen barrel assembling device "A" of the present invention comprises a base 1 and a first frame 2 is fixed to the top of the first end of the base 1 by extending bolts 12 (only one is shown) through holes 11 in the body 21 of the first frame 2. A movable rod 22 extends through a passage 211 defined longitudinally through the body 21 of the first frame 2. A first fixing bolt 212 extends through the first frame 2 and fixes the movable rod 22 relative to the first frame 2. An end part 23 is connected to the first end of the movable rod 22 and a recess 231 defined in the free end of the end part 23. The end part 23 has a recess 231 defined in the free end thereof so as to receive the outer section 6 therein. A positioning member 25 is mounted to the second end of the movable rod 22 and a second fixing bolt 251 extends through the positioning member 25 and contacts the movable rod 22. A spring 24 is connected between the first and second fixing bolts 212, 251.

A push unit 3 is connected to the top of the second end of the base 1 and has a second frame 31 with a push rod 32 extending through the through hole 311 in the second frame 31. The push rod 32 is located in alignment with the movable rod 22. A link 35 is pivotably connected between the push rod 32 and a lever 34, so that the push rod 32 is moved toward the movable rod 22 by pivoting the lever 34. A head 33 is connected to the free end of the push rod 34 and the metal section 7 is connected to the head 33.

Figure 3A:
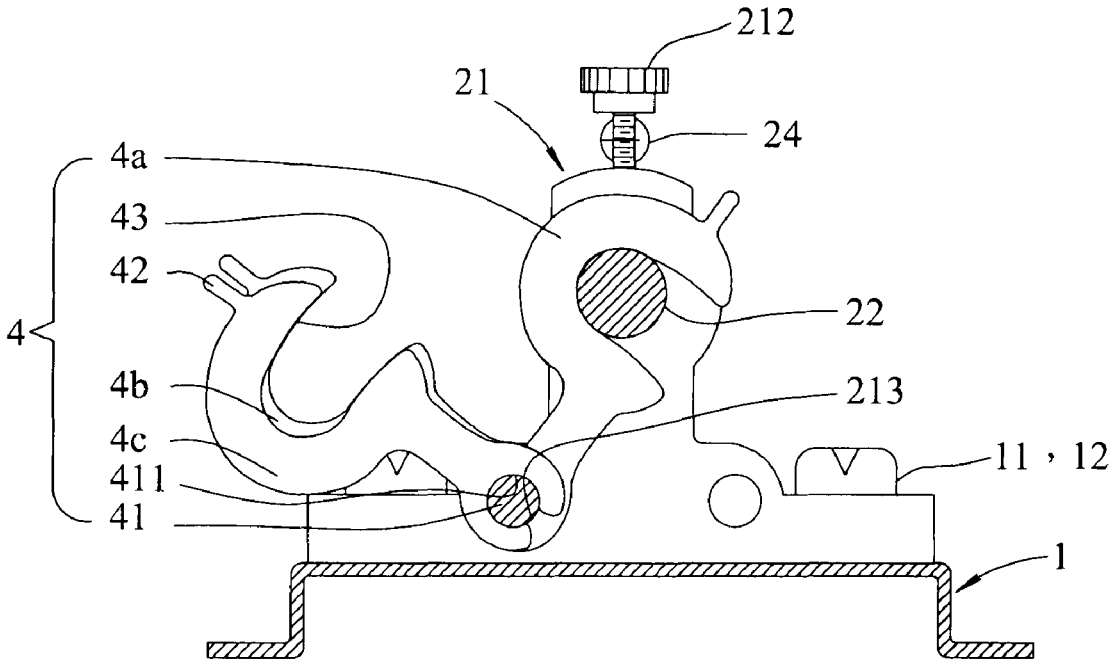
FIG. 3*a* is an end cross sectional view taken along line a-a in FIG. 3.

Further referring to FIG. 3*a*, multiple blocks 4*a*, 4*b*, 4*c* are pivotably connected to the base 1 and each block 4*a*/4*b*/4*c* includes an engaging recess 43 which is sized to be removably engaged with the movable rod 22. The multiple blocks 4*a*, 4*b*, 4*c* have different lengths. Each of the multiple blocks 4*a*, 4*b*, 4*c* includes a path 411 and a pin 41 extends through the respective paths 411 of the multiple blocks 4*a*, 4*b*, 4*c* and is connected to the reception hole 213 in the body 21 of the fixing frame 2 so that the multiple blocks 4*a*, 4*b*, 4*c* are pivotable about the pin 41. Each of the multiple blocks 4*a*, 4*b*, 4*c* has a flange 42 extending therefrom so that the user can pivot the blocks 4*a*, 4*b*, 4*c* by lifting the flanges 42.

Figure 4:
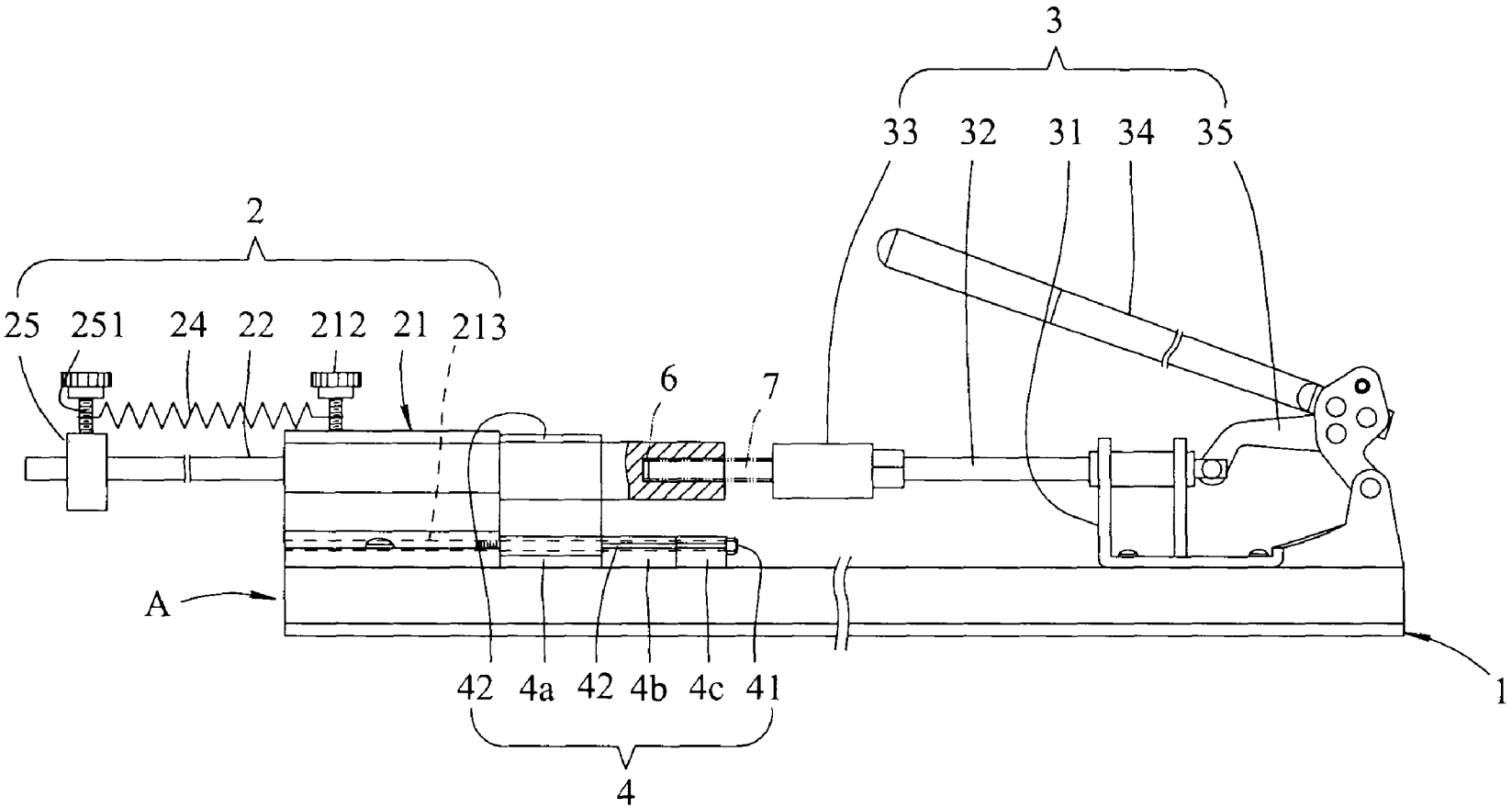
FIG. 4 shows that the metal section is inserted into the outer section of the pen barrel in FIG. 3.
Figure 5:
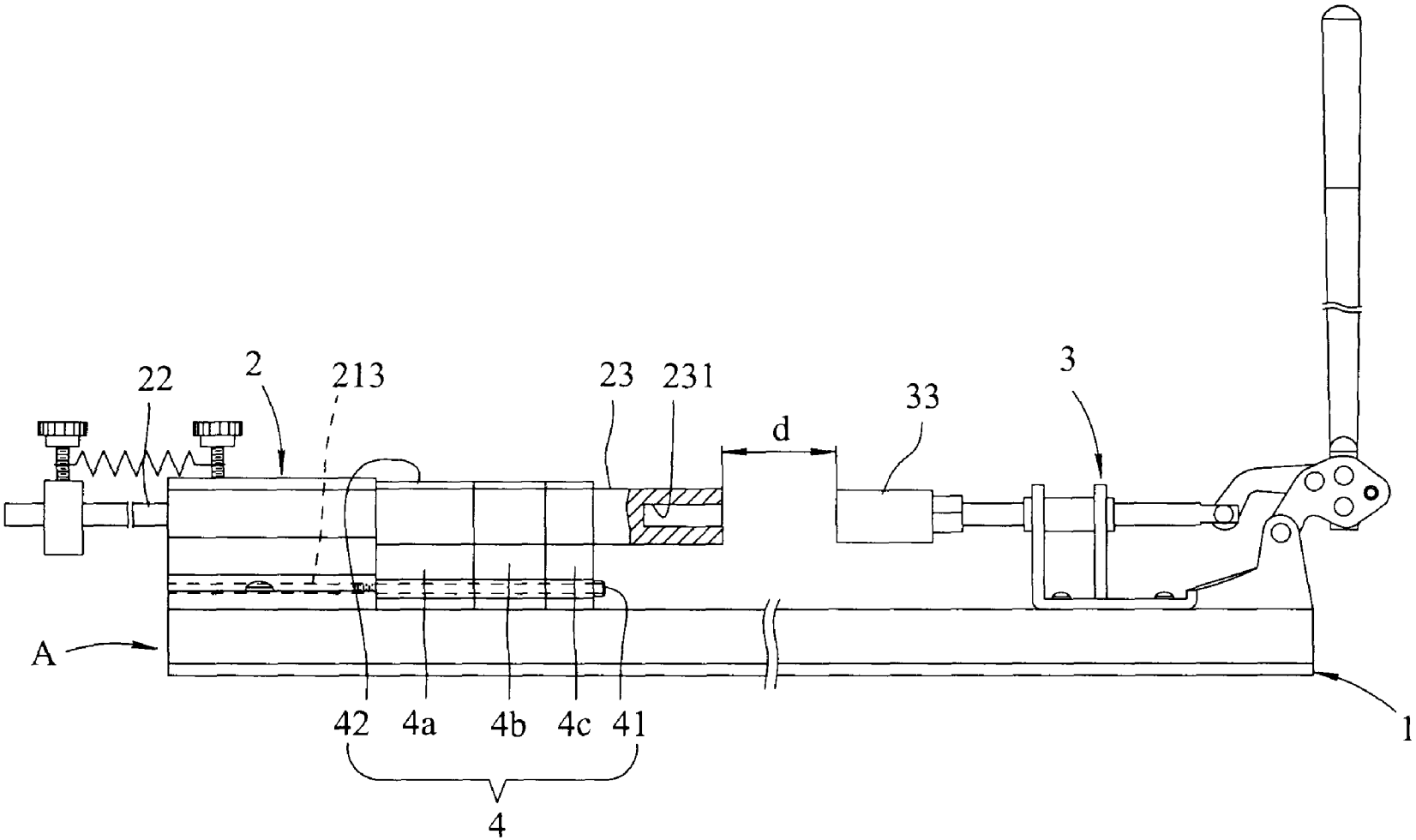
FIG. 5 shows the distance between the end part and the head of the pen barrel assembling device of the present invention.

Referring to FIGS. 4 and 5, when using the pen barrel assembling device "A", the desired block(s) 4*a*, 4*b*, 4*c* are pivoted about the pin 41 to allow the engaging recesses 43 to be engaged with the movable rod 22. The first fixing bolt 212 is first unscrewed so that the movable rod 22 is not positioned and the blocks block(s) 4*a*, 4*b*, 4*c* can be clamped between the body 21 and the end part 23. Then the first fixing bolt 212 is screwed to lock the movable rod 22 and the distance "d" between the end part 23 and the head 33 is fixed. The metal section 7 on the head 33 is then inserted into the outer section 6 on the end part 23 by pivoting the lever 34 to form the pen barrel. The blocks 4*a*, 4*b*, 4*c* are well positioned on the base 1 and will not be lost.

Figure 6:
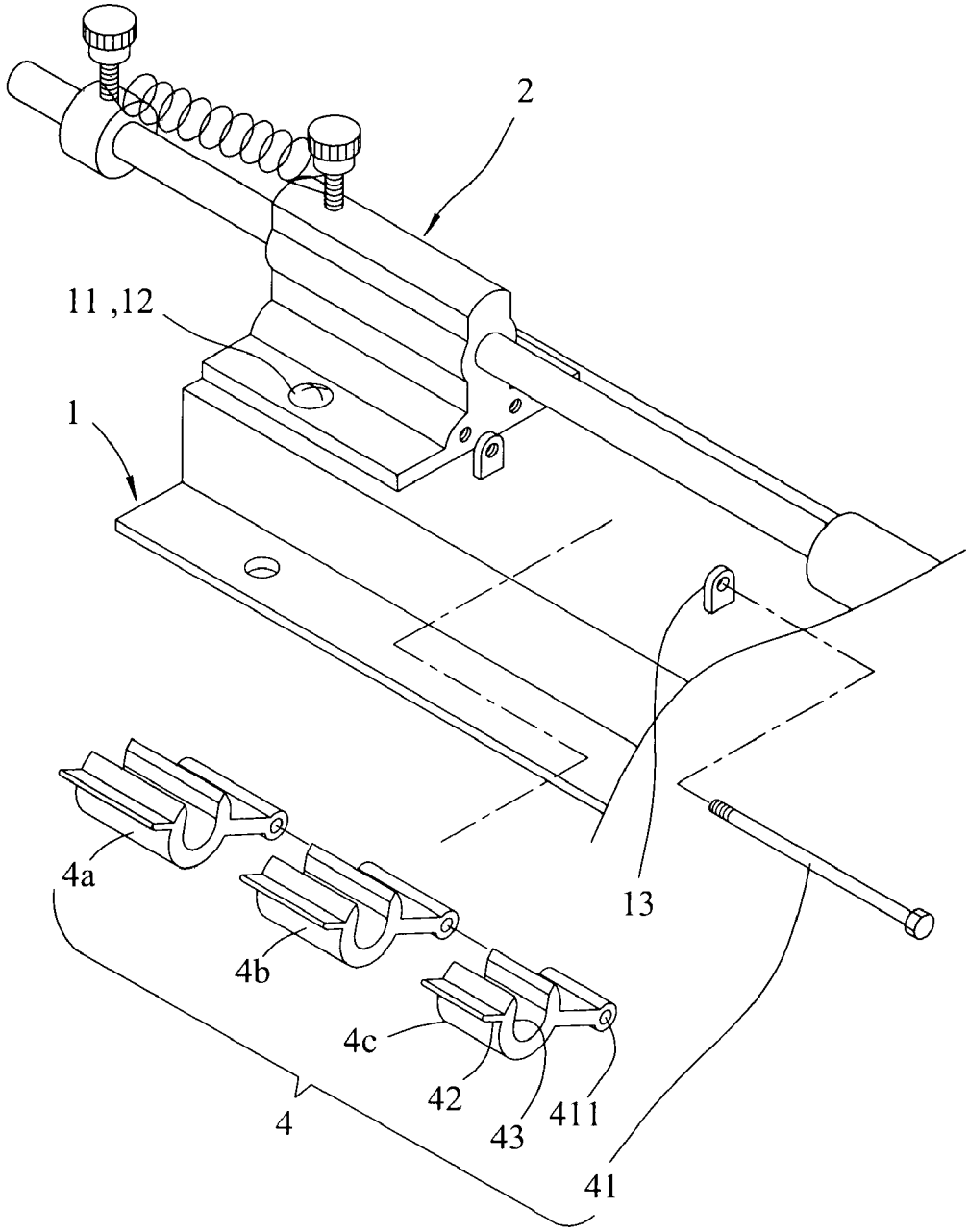
FIG. 6 is an exploded view to show another embodiment of the pen barrel assembling device of the present invention.

FIG. 6 shows the second embodiment wherein two lugs 13 extend from the top of the base 1 and the multiple blocks 4*a*, 4*b*, 4*c* are located between the two lugs 13. The pin 41 extends through the two lugs 13 and the paths 411 of the multiple blocks 4*a*, 4*b*, 4*c*.

Figure 7:
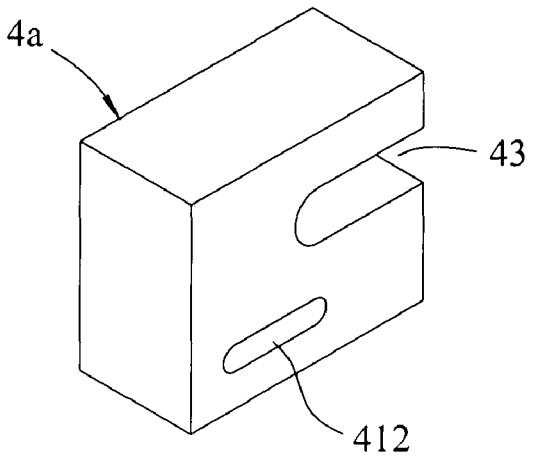
FIG. 7 shows the second embodiment of the block of the pen barrel assembling device of the present invention.
Figure 7A:
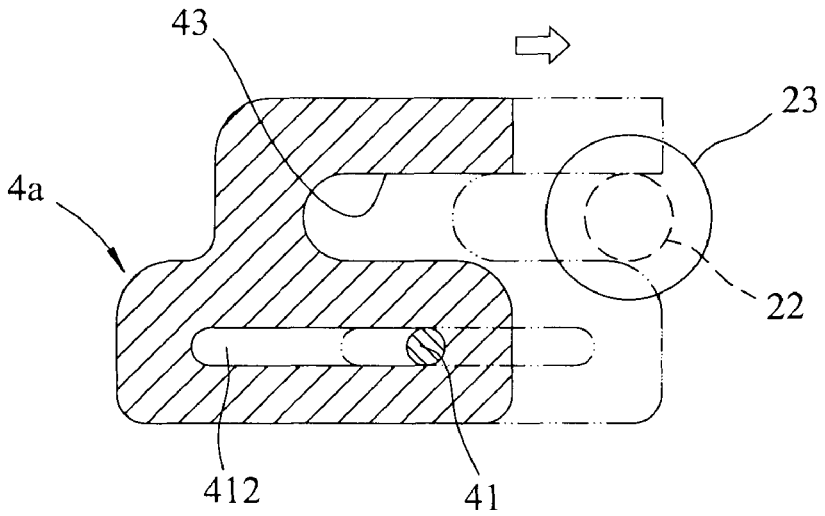
FIG. 7*a* is a cross sectional view to show that the corners of the block in FIG. 7 are trimmed to be rounded and the block is moved toward the movable rod.

FIG. 7 shows the second embodiment of the blocks 4*a*, 4*b*, 4*c* wherein the paths each are an elongate hole 412 and the blocks 4*a*, 4*b*, 4*c* are slidable while the pin 41 is relatively moved in the elongate hole 412. FIG. 7*a* shows that the corners of the block 4*a*/4*b*/4*c* in FIG. 7 are trimmed to be rounded and the block 4*a*/4*b*/4*c* is moved toward the movable rod 22.

Figure 7B:
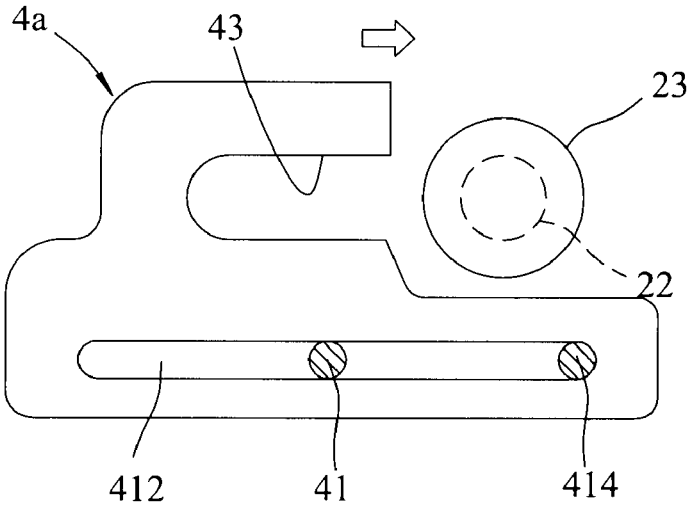
FIG. 7*b* shows the third embodiment of the block of the pen barrel assembling device of the present invention.

FIG. 7*b* shows the third embodiment of the blocks 4*a*, 4*b*, 4*c* wherein the first and second pins 41, 414 both extend through the elongate hole 412 to prevent rotation when the blocks 4*a*, 4*b*, 4*c* are slid toward the movable rod 22.

Figure 7C:
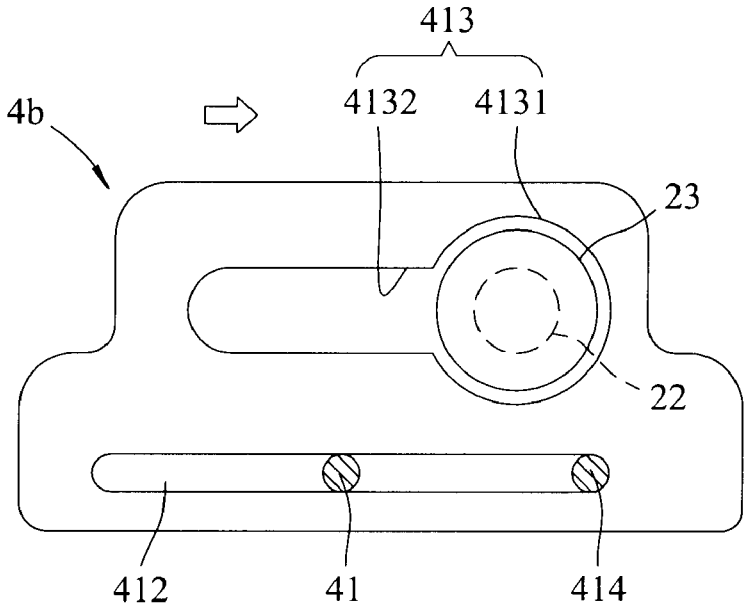
FIG. 7*c* shows the fourth embodiment of the block of the pen barrel assembling device of the present invention.

FIG. 7*c* shows the fourth embodiment of the blocks 4*a*, 4*b*, 4*c* wherein the engaging recess in each of the blocks 4*a*, 4*b*, 4*c* is an enclosed elongate slot 413 which is composed of an circular hole 4131 and an elongate hole 4132 which communicates with the circular hole 4131. The movable rod 22 movably extends through the enclosed elongate slot 413.

Figure 8:
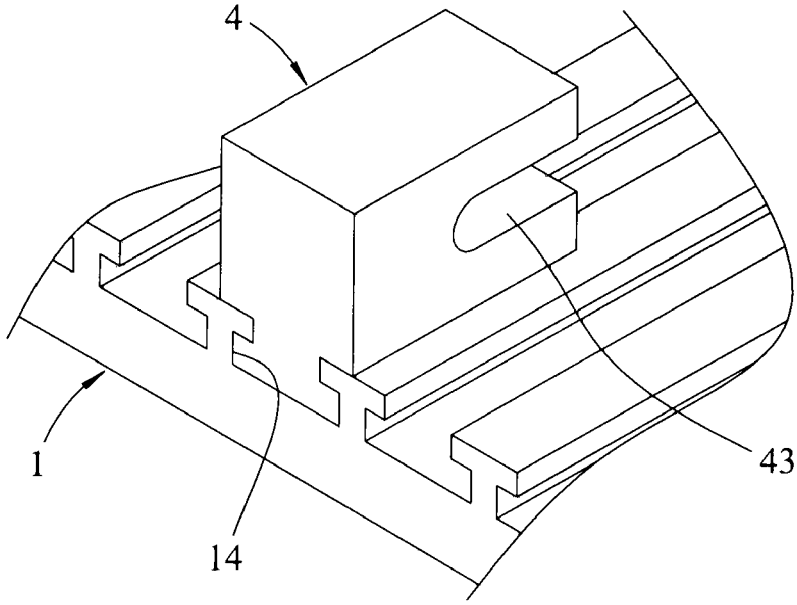
FIG. 8 shows that the blocks are slidably engaged with sliding slots on the base.
Figure 8A:
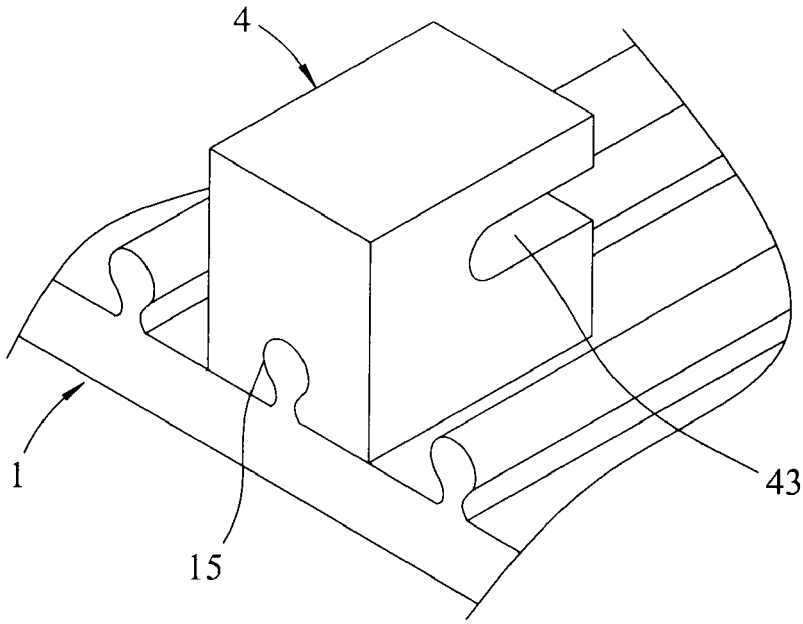
FIG. 8*a* shows that the blocks are slidably engaged with rails on the base.
Figure 9:
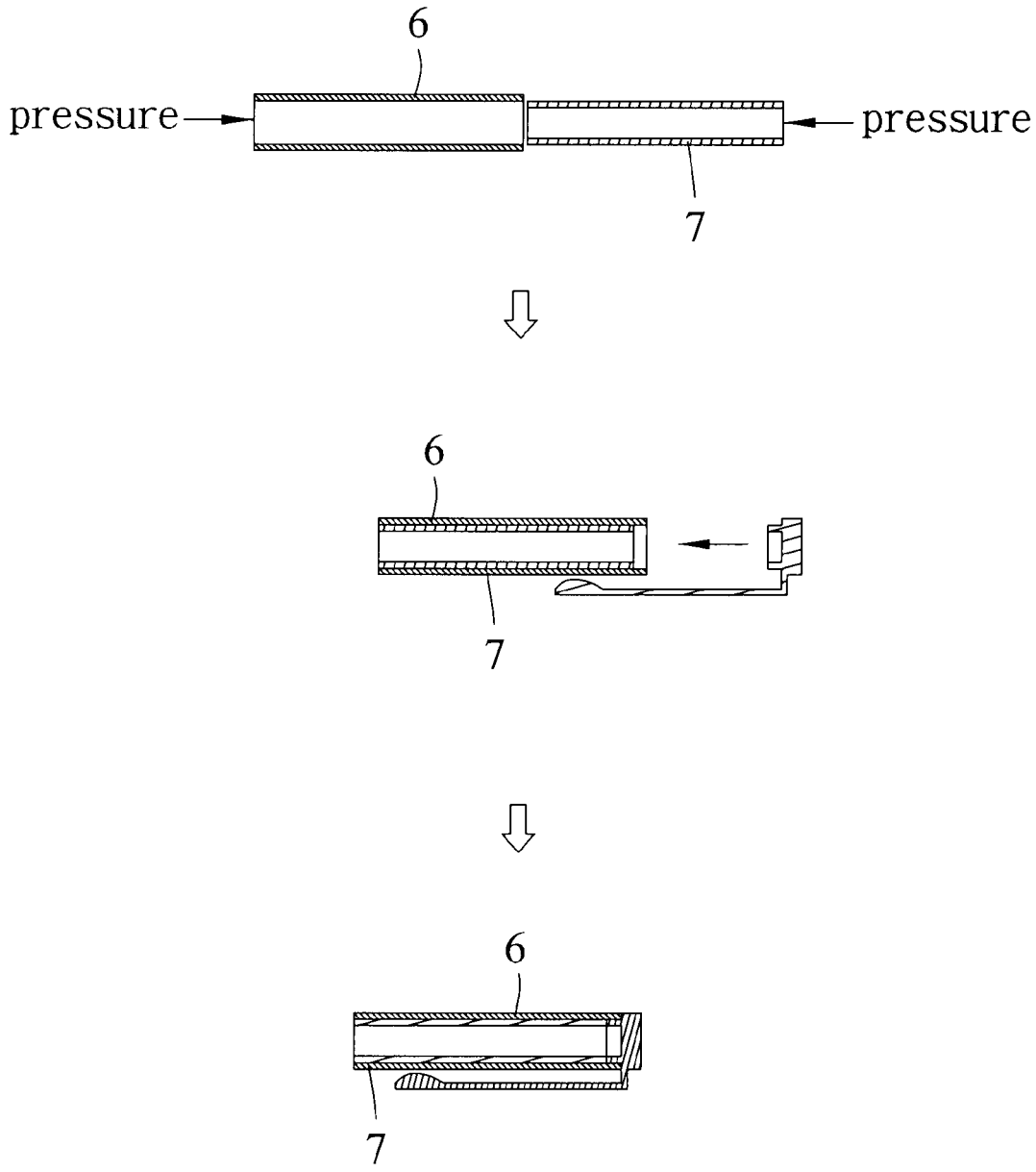
FIG. 9 PRIOR ART
FIG. 9 shows the conventional way for assembling the pen barrel.
Figure 10:
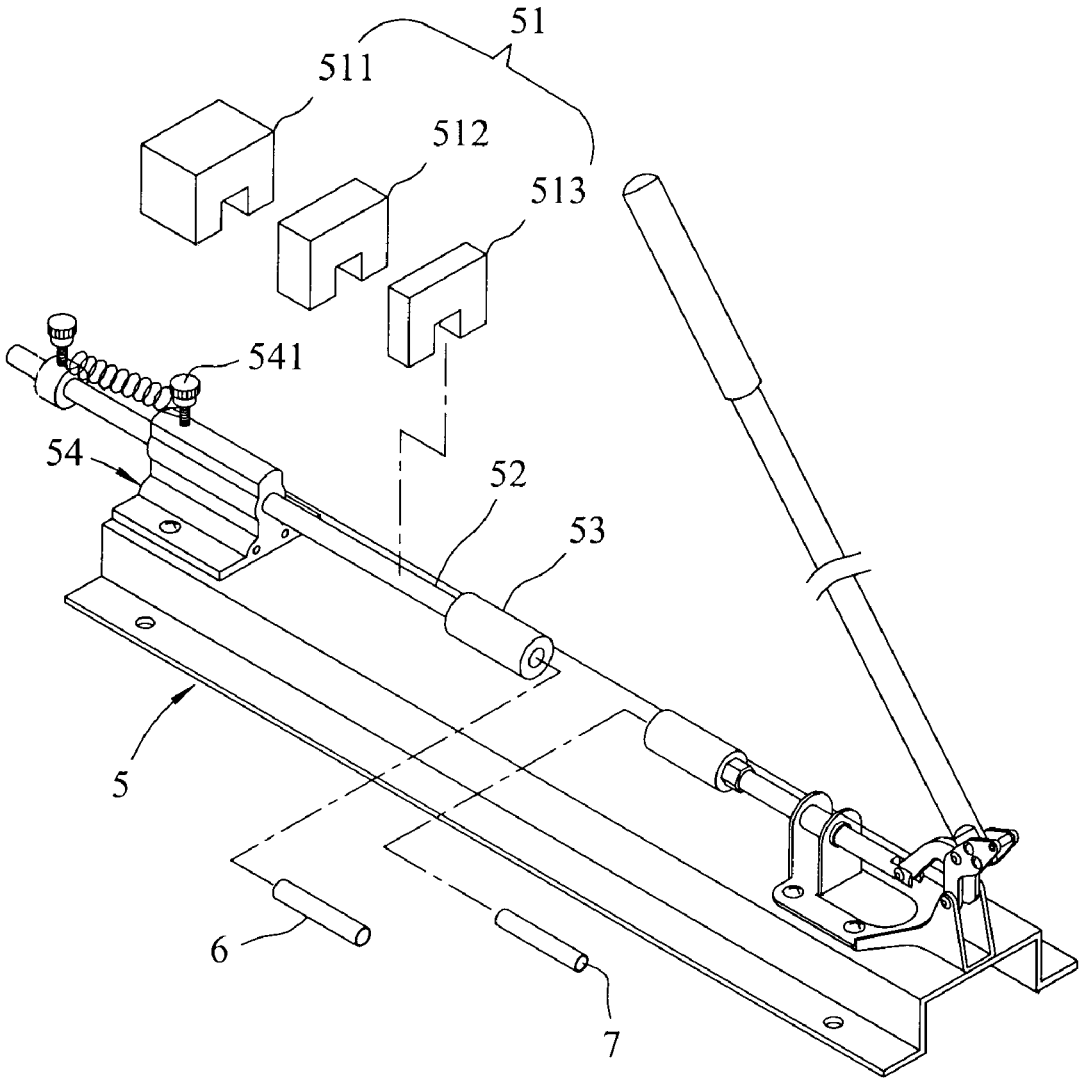
FIG. 10 PRIOR ART
FIG. 10 shows the conventional pen barrel assembling device.

FIG. 8 shows that the base 1 has multiple sliding slots 14 with which the blocks 4*a*, 4*b*, 4*c* are slidably engaged. Alternatively, the base 1 may have multiple rails 15 to which the blocks 4*a*, 4*b*, 4*c* are slidably mounted.

While we have shown and described the embodiment in accordance with the present invention, it should be clear to those skilled in the art that further embodiments may be made without departing from the scope of the present invention.

What is claimed is:

1. A pen barrel assembling device comprising:

a base and a first frame fixed to a top of a first end of the base, a movable rod extending through a passage defined longitudinally through the first frame, a first fixing bolt extending through the first frame and fixed the movable rod relative to the first frame, an end part connected to a first end of the movable rod and a recess defined in a free end of the end part;

a push unit connected to the top of a second end of the base and having a second frame with a push rod extending therethrough which is located in alignment with the movable rod, a link pivotably connected between the push rod and a lever, the push rod being moved by pivoting the lever, a head connected to a free end of the push rod, and multiple blocks pivotably or slidably connected to the base and each block including an engaging recess which is removably engaged with the movable rod.

2. The device as claimed in claim 1, wherein a positioning member is mounted to a second end of the movable rod and a second fixing bolt extends through the positioning member and contacts the movable rod, a spring is connected between the first and second fixing bolts.

3. The device as claimed in claim 1, wherein each of the multiple blocks includes a path and a first pin extends through the respective paths of the multiple blocks and is connected to the fixing frame so that the multiple blocks are pivotable about the first pin.

4. The device as claimed in claim 1, wherein each of the multiple blocks has a flange extending therefrom.

5. The device as claimed in claim 3, wherein two lugs extend from the top of the base and the multiple blocks are located between the two lugs, the first pin extends through the two lugs and the paths of the multiple blocks.

6. The device as claimed in claim 3, wherein the paths each are an elongate hole and the blocks are slidable while the first pin is relatively moved in the elongate hole.

7. The device as claimed in claim 6, wherein a second pin extends through the elongate hole to prevent the blocks from rotation.

8. The device as claimed in claim 6, wherein the engaging recess in each of the blocks is an enclosed elongate slot which is composed of an circular hole and an elongate hole which communicates with the circular hole, the movable rod movably extending through the enclosed elongate slot.

9. The device as claimed in claim 1, wherein the base has multiple sliding slots with which the blocks are slidably engaged.

10. The device as claimed in claim 1, wherein the base 1 has multiple rails to which the blocks are slidably mounted.

* * * * *